US010184750B2

(12) United States Patent
McPherson

(10) Patent No.: US 10,184,750 B2
(45) Date of Patent: Jan. 22, 2019

(54) LIMB CUP WITH AXLE

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 14/942,806

(22) Filed: Nov. 16, 2015

(65) Prior Publication Data

US 2017/0138691 A1 May 18, 2017

(51) Int. Cl.
*F41B 5/14* (2006.01)
*F41B 5/12* (2006.01)

(52) U.S. Cl.
CPC ..... *F41B 5/1403* (2013.01); *F41B 5/123* (2013.01)

(58) Field of Classification Search
CPC ..... F41B 5/10; F41B 5/14
USPC ..... 124/23.1, 25.6, 86, 88
See application file for complete search history.

(56) References Cited

U.S. PATENT DOCUMENTS

| | | | | |
|---|---|---|---|---|
| 480,879 | A | | 8/1892 | Stevenson |
| RE13,844 | E | | 4/1912 | Sawyer |
| 1,371,619 | A | | 3/1921 | Greenstreet |
| 3,161,189 | A | | 12/1964 | Chessman |
| 3,486,495 | A | | 12/1969 | Allen |
| 4,178,905 | A | | 12/1979 | Groner |
| 4,261,320 | A | | 4/1981 | Bama |
| 4,574,766 | A | | 3/1986 | Izuta |
| 4,644,929 | A | | 2/1987 | Peck |
| 4,674,468 | A | | 6/1987 | Izuta |
| 5,025,774 | A | | 6/1991 | Martin |
| 5,099,819 | A | | 3/1992 | Simonds et al. |
| 5,172,679 | A | | 12/1992 | Mussack |
| 5,231,970 | A | | 8/1993 | Ploot |
| 5,280,779 | A | * | 1/1994 | Smith ..... F41B 5/0026 124/23.1 |
| 5,339,790 | A | * | 8/1994 | Smith ..... F41B 5/10 124/23.1 |
| 5,368,006 | A | | 11/1994 | McPherson |
| 5,377,658 | A | | 1/1995 | Shepley, Jr. |
| 5,408,982 | A | | 4/1995 | Doornenbal |
| 5,411,008 | A | | 5/1995 | Hsu |
| 5,429,106 | A | | 7/1995 | Martin et al. |
| 5,433,792 | A | | 7/1995 | Darlington |
| 5,464,001 | A | | 11/1995 | Peck |
| 5,487,373 | A | | 1/1996 | Smith |
| 5,507,270 | A | | 4/1996 | Smith |
| 5,515,836 | A | | 5/1996 | Martin et al. |
| 5,546,923 | A | | 8/1996 | Duncan |
| 5,592,929 | A | * | 1/1997 | Hoyt, Jr. ..... F41B 5/0005 124/23.1 |
| 5,660,158 | A | * | 8/1997 | Rudolph ..... F41B 5/0026 124/23.1 |
| 5,697,355 | A | | 12/1997 | Schaffer |
| 5,697,358 | A | | 12/1997 | Campisi |
| 5,720,267 | A | * | 2/1998 | Walk ..... F41B 5/10 124/23.1 |
| 5,722,380 | A | | 3/1998 | Land et al. |
| 5,947,099 | A | | 9/1999 | Derus |

(Continued)

*Primary Examiner* — Alexander Niconovich

(57) ABSTRACT

In some embodiments, a limb cup comprises a body and a limb support member. The body defines a cavity suitable to receive a limb. The limb support member is attached to the body and rotatable with respect to the body.

20 Claims, 8 Drawing Sheets

(56) References Cited

U.S. PATENT DOCUMENTS 6,024,076 A * 2/2000 Laborde ..... F41B 5/0026 124/23.1
6,244,259 B1 * 6/2001 Adkins ..... F41B 5/0026 124/23.1
6,257,220 B1 7/2001 McPherson et al.
6,267,108 B1 7/2001 McPherson et al.
6,360,734 B1 3/2002 Andrews
6,371,098 B1 4/2002 Winther
6,470,870 B1 10/2002 Schaar
6,543,432 B2 4/2003 Andrews et al.
6,571,785 B1 6/2003 Choma
6,712,057 B2 3/2004 Andrews
6,786,214 B2 9/2004 Andrews
6,886,549 B2 5/2005 McPherson
6,941,937 B2 9/2005 Wheeler
6,964,271 B2 11/2005 Andrews
7,025,051 B1 4/2006 Gallops, Jr.
7,077,116 B1 7/2006 Darlington
7,308,890 B1 * 12/2007 Wheeler ..... F41B 5/10 124/23.1
7,334,575 B2 2/2008 McPherson
7,584,750 B2 9/2009 Chang
7,784,452 B1 * 8/2010 Kronengold ..... F41B 5/10 124/23.1
7,918,218 B1 4/2011 Kronengold et al.
8,047,189 B2 * 11/2011 McPherson ..... F41B 5/10 124/23.1
8,069,847 B2 * 12/2011 Blosser ..... F41B 5/10 124/23.1
8,281,773 B2 * 10/2012 Dahl, II ..... F41B 5/10 124/23.1
8,347,869 B2 * 1/2013 Sims ..... F41B 5/10 124/23.1
8,453,635 B1 6/2013 McPherson
8,701,644 B2 4/2014 McPherson
8,776,770 B2 * 7/2014 Batdorf ..... F41B 5/10 124/23.1
8,844,508 B2 * 9/2014 Sims ..... F41B 5/10 124/25
8,851,056 B2 * 10/2014 Trpkovski ..... F41B 5/10 124/23.1
9,103,622 B2 * 8/2015 Park ..... F41B 5/0026
9,285,180 B2 3/2016 McPherson
9,581,406 B1 * 2/2017 Nevels ..... F41B 5/1403
2003/0084893 A1 5/2003 Andrews
2004/0074485 A1 * 4/2004 Cooper ..... F41B 5/10 124/25.6
2004/0077440 A1 4/2004 Kronfeld
2006/0011181 A1 * 1/2006 Andrews ..... F41B 5/1426 124/23.1
2008/0072888 A1 3/2008 Chang
2008/0127961 A1 6/2008 McPherson
2008/0156310 A1 7/2008 Leven
2008/0236557 A1 10/2008 Budd
2009/0071457 A1 3/2009 Gordon et al.
2009/0071458 A1 3/2009 Gordon et al.
2009/0145411 A1 6/2009 Sims et al.
2009/0241928 A1 10/2009 Blosser
2010/0089375 A1 * 4/2010 McPherson ..... F41B 5/105 124/25.6
2010/0263650 A1 10/2010 Dahl, II et al.
2014/0283804 A1 * 9/2014 Badgerow ..... F41B 5/10 124/23.1
2015/0136105 A1 * 5/2015 McPherson ..... F41B 5/105 124/25.6
2015/0226511 A1 * 8/2015 Chang ..... F41B 5/1403 124/23.1
2016/0091273 A1 * 3/2016 Denton ..... F41B 5/0052 124/23.1

* cited by examiner

LIMB CUP WITH AXLE

BACKGROUND OF THE INVENTION

This invention relates generally to archery bows and more particularly to a limb cup suitable for use with an archery bow.

Archery bows are generally known in the art and include vertical bows and crossbows. Bows generally include limbs that flex and store power as the bow is drawn. Limbs are often made from materials that are different from other portions of the bow and must be attached to the bow.

There remains a need for novel structures for supporting a bow limb. There remains a need for bow arrangements that minimize localized stresses on a bow limb.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a limb cup comprises a body and a limb support member. The body defines a cavity suitable to receive a limb. The limb support member is attached to the body and rotatable with respect to the body.

In some embodiments an archery bow comprises a frame, a limb and a limb cup. The limb cup comprises a body member defining a cavity and a limb support member. The limb support member is rotatable with respect to the body member. A portion of the limb is oriented in the cavity and a portion of the limb contacts the limb support member.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
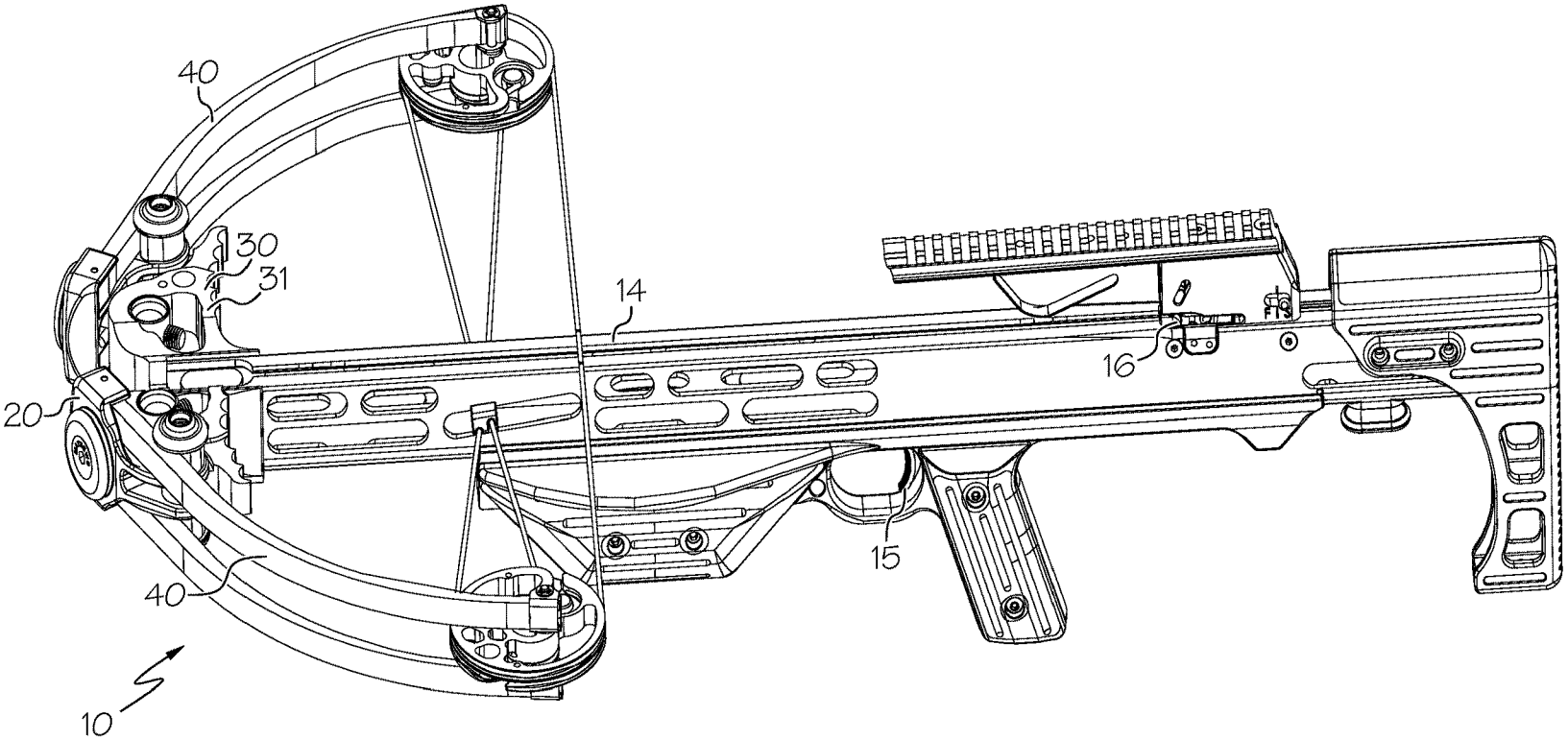
FIG. 1 shows an embodiment of a crossbow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a bow 10 comprising an embodiment of a limb cup 20. FIG. 1 illustrates a crossbow 11, which includes a stock 14, a trigger 15 and a latch 16. In other embodiments, a bow 10 can comprise a traditional, vertical style archery bow.

Desirably, the bow 10 comprises a frame 30. In a vertical bow, a frame can comprise a riser. In a crossbow 11, the frame 30 can comprise a prod 31. In some embodiments, the frame 30 supports one or more limbs 40.

In some embodiments, a limb cup 20 is supported by the frame 30. In some embodiments, a limb cup 20 is configured to receive and support one or more limbs 40.

Figure 2:
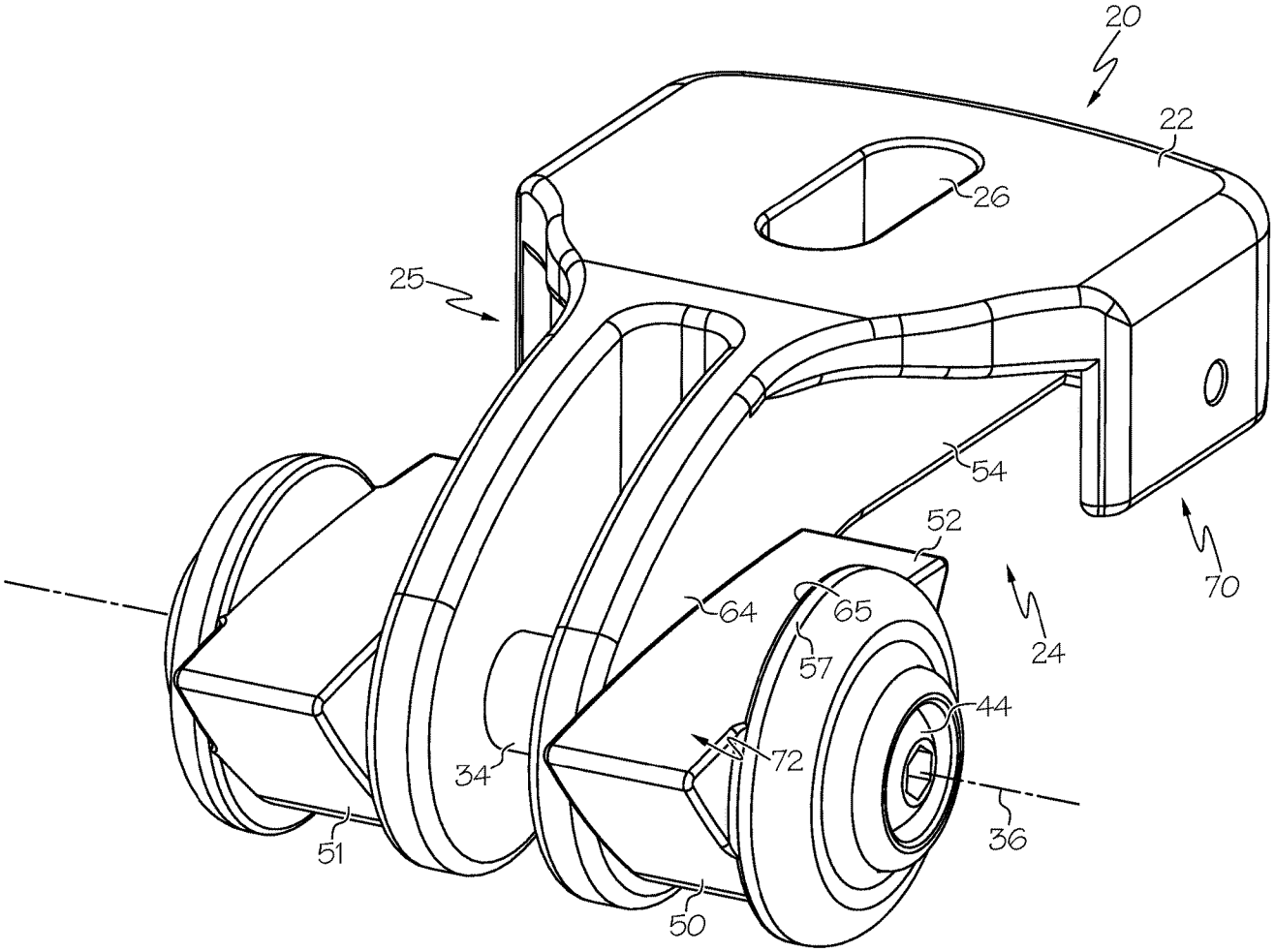
FIG. 2 shows an embodiment of a limb cup.
Figure 3:
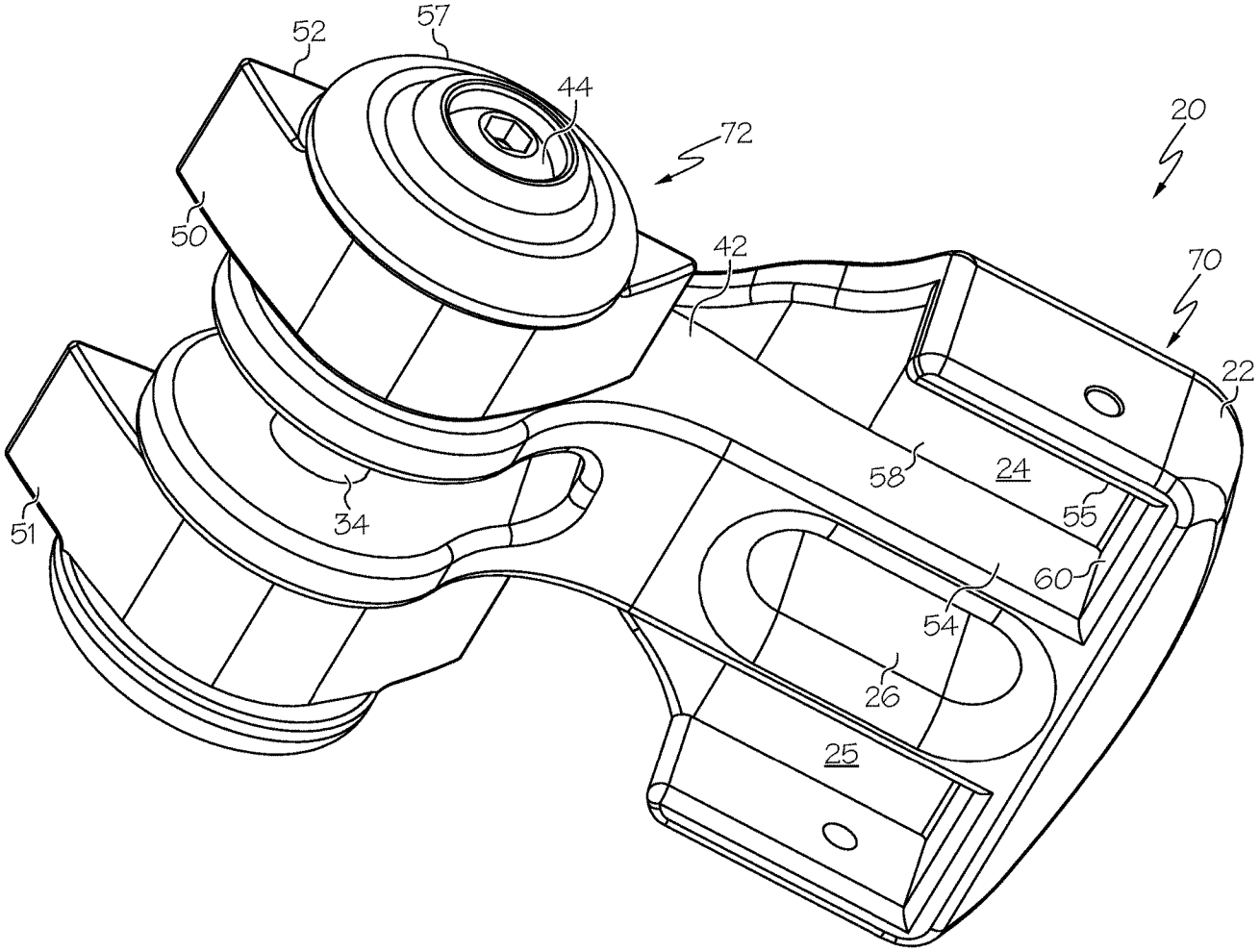
FIG. 3 shows the limb cup of FIG. 2 from another viewing angle.
Figure 4:
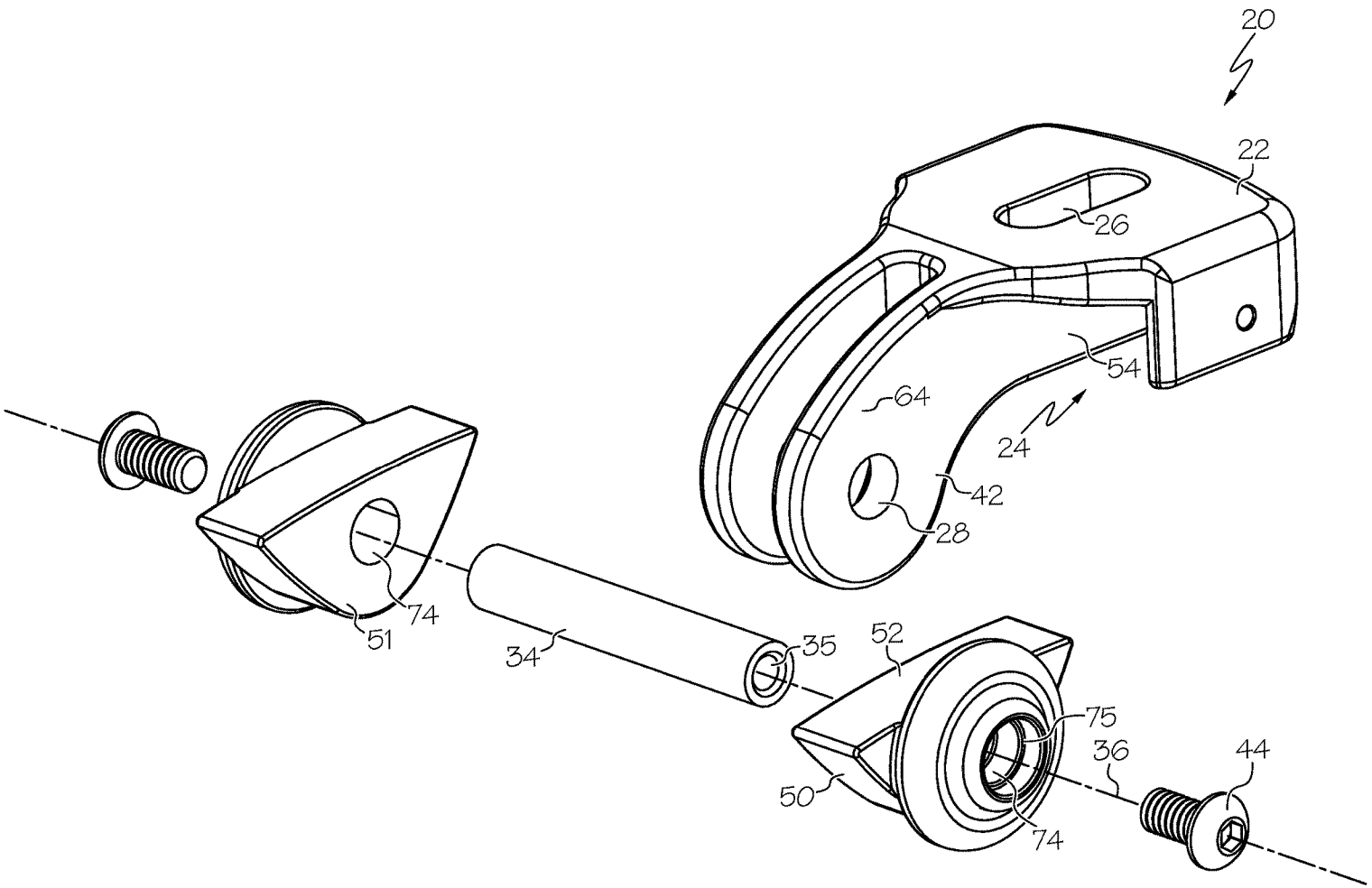
FIG. 4 shows an exploded view of the limb cup of FIG. 2.

FIGS. 2-4 show an embodiment of a limb cup 20. FIG. 4 shows an exploded view. The limb cup 20 shown is suitable for use on any type of bow, such as vertical bows and crossbows. Desirably, the limb cup 20 comprises a body member 22 and a limb support member 50. Desirably, the limb support member 50 is moveable with respect to the body member 22. In some embodiments, the limb support member 50 is rotatable with respect to the body member 22 about a pivot axis 36.

Desirably, the body member 22 comprises a cavity 24 that is constructed an arranged to receive a limb. In some embodiments, the cavity 24 is defined by a first sidewall 54 and a second sidewall 55. In some embodiments, the cavity 24 is defined by a top wall 58. In some embodiments, a top wall 58 is oriented orthogonally to the sidewalls 54, 55. In some embodiments, the cavity 24 is defined by an end wall 60.

In some embodiments, the limb cup 20 is arranged to support a limb at a first support location 70 and a second support location 72. The first support location 70 can comprise the cavity 24 of the body member 22, wherein the limb cup 20 can support a tension surface of the limb. The second support location 72 can comprise the limb support member 50, wherein the limb cup 20 can support a compression surface of the limb.

Desirably, a bow limb can be received in the cavity 24 and a tension surface of the limb can abut the top wall 58. Lateral sides of the limb can be positioned adjacent to the first sidewall 54 and second sidewall 55. The limb can extend from the cavity 24 and contact the limb support member 50.

In some embodiments, the second support location 72 comprises a first sidewall 64. In some embodiments, a surface 42 of the body member 22 comprises the first sidewall 54 of the first support location 70 and the first sidewall 64 of the second support location 72. In some embodiments, the second support location 72 comprises a limb pad 52, which can abut a compression surface of a limb. In some embodiments, the second support location 72 comprises a second sidewall 65 located opposite the first sidewall 64. In some embodiments, the limb support member 50 comprises a flange 57 that comprises the second sidewall 65.

In some embodiments, a limb cup 20 comprises an axle 34. In some embodiments, a central axis of the axle 34 is aligned upon the pivot axis 36. In some embodiments, the axle 34 defines the pivot axis 34. In some embodiments, the body member 22 comprises an aperture 28, and the axle 34 extends through the aperture 28. In some embodiments, the aperture 28 is formed in a surface that also comprises the first sidewall 54 that defines the cavity 24. In some embodiments, the axle 34 is rotatable with respect to the body member 22.

In some embodiments, the limb support member 50 is attached to the axle 34. In some embodiments, the limb support member 50 is supported by the axle 34. In some embodiments, the limb support member 50 is rotatable with respect to the axle 34 about the pivot axis 36. In some embodiments, the limb support member 50 is attached to the axle 34 with a fastener 44. In some embodiments, the axle 34 comprises a cavity 35 that receives the fastener 44. In some embodiments, the cavity 35 is located in an end of the axle 34. In some embodiments, the cavity 35 is oriented in an axial direction of the axle 34. In some embodiments, the cavity 35 is threaded.

In some embodiments, the limb support member 50 comprises a cavity 74 and a portion of the axle 34 is oriented in the cavity 74. In some embodiments, the fastener 44 can also be received in the cavity 74. In some embodiments, the cavity 74 changes in size along its length. In some embodiments, the cavity 74 comprises a flange 75, and a head of the fastener 44 can abut the flange 75.

In some embodiments, the limb pad 52 comprises curvature and is concave with respect to the pivot axis 36.

In some embodiments, the limb cup 20 described herein is optimized for use with a single limb. In some embodiments, a limb cup 20 is arranged to receive a second limb member, and comprises a second cavity 25 and a second limb support member 51. In some embodiments, a second cavity 25 is arranged similar to a first cavity 24 as described herein. In some embodiments, a second cavity 25 comprises a mirror image of the first cavity 24. In some embodiments, a second limb support member 51 is arranged similar to a first limb support member 50 as described herein. In some embodiments, a second limb support member 51 comprises a mirror image of the first limb support member 50.

In some embodiments, a limb cup 20 comprise a limb bolt aperture 26. In some embodiments, a limb bolt aperture 26 is located between a first cavity 24 and a second cavity 25.

Figure 5:
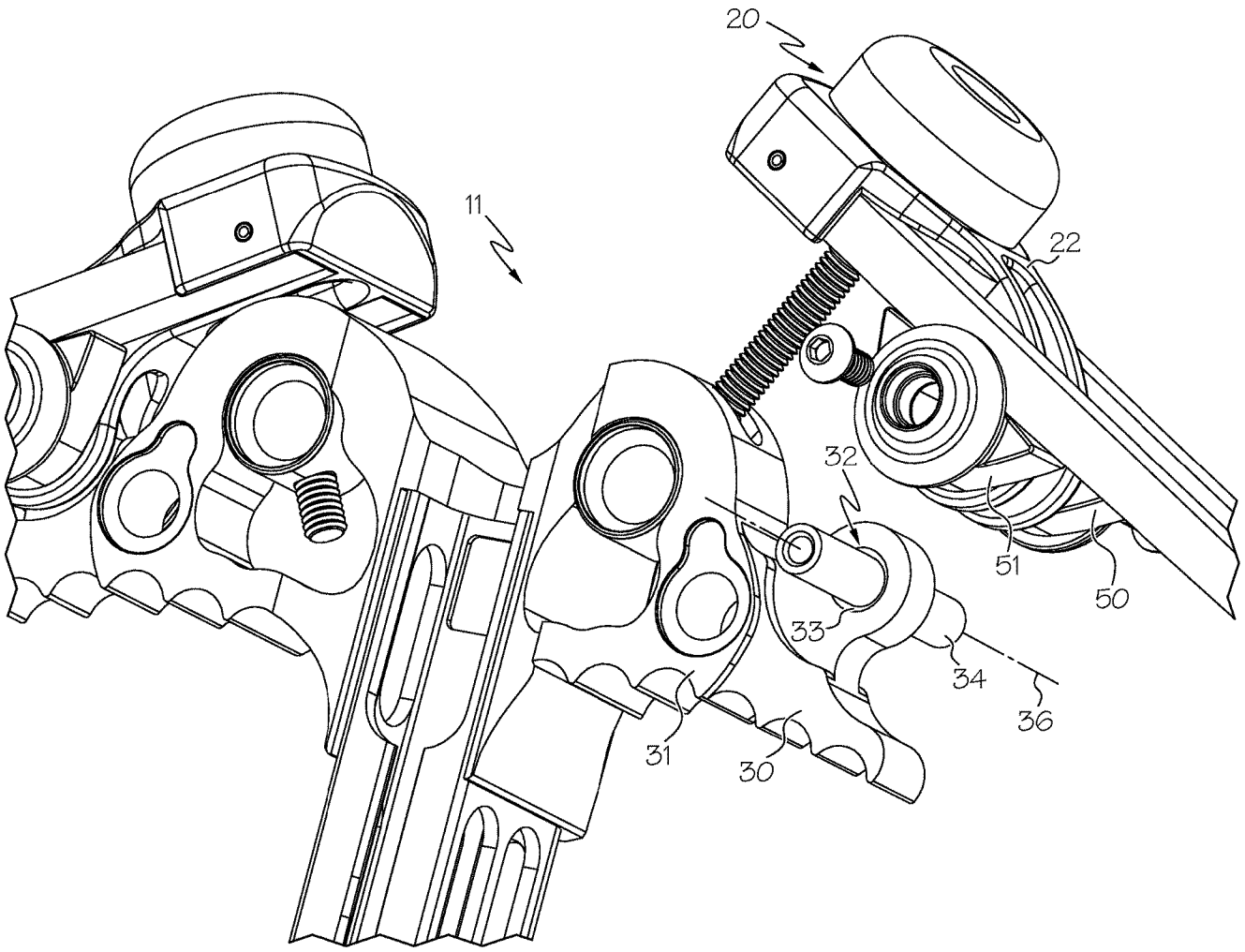
FIG. 5 shows an exploded view of an embodiment of a crossbow.

FIG. 5 shows an exploded view of an embodiment of a crossbow 11 and an embodiment of a prod 31. In some embodiments, a frame 30 is arranged to abut an axle 34. In some embodiments, the frame 30 comprises a concave surface 33 arranged to abut the axle 34. In some embodiments, the concave surface 33 is concave with respect to the pivot axis 36. In some embodiments, the frame 30 comprises an aperture 32 and the axle 34 extends through the aperture 32. In some embodiments, the frame 30 surrounds the axle 34.

Figure 6:
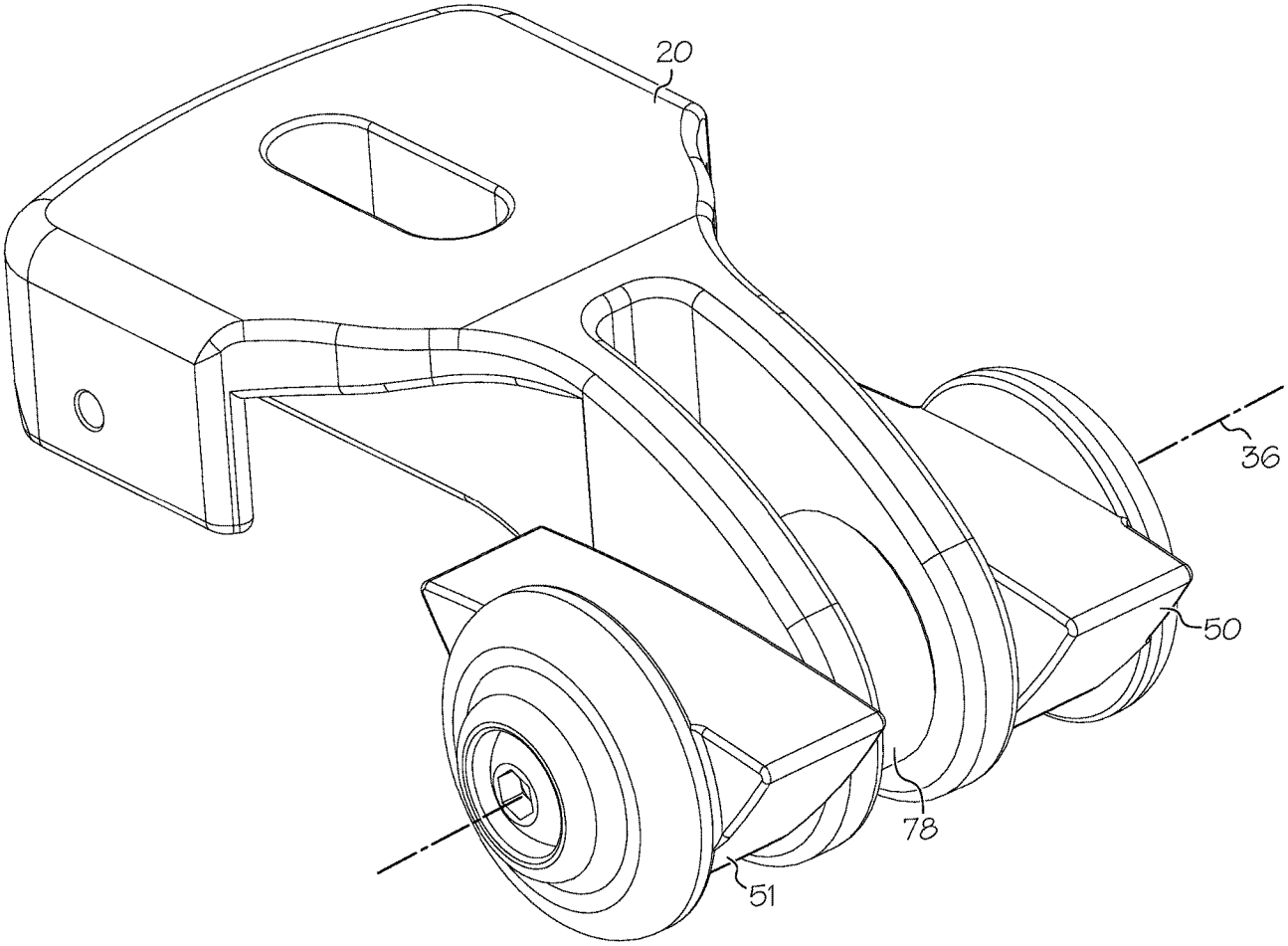
FIG. 6 shows another embodiment of a limb cup.
Figure 7:
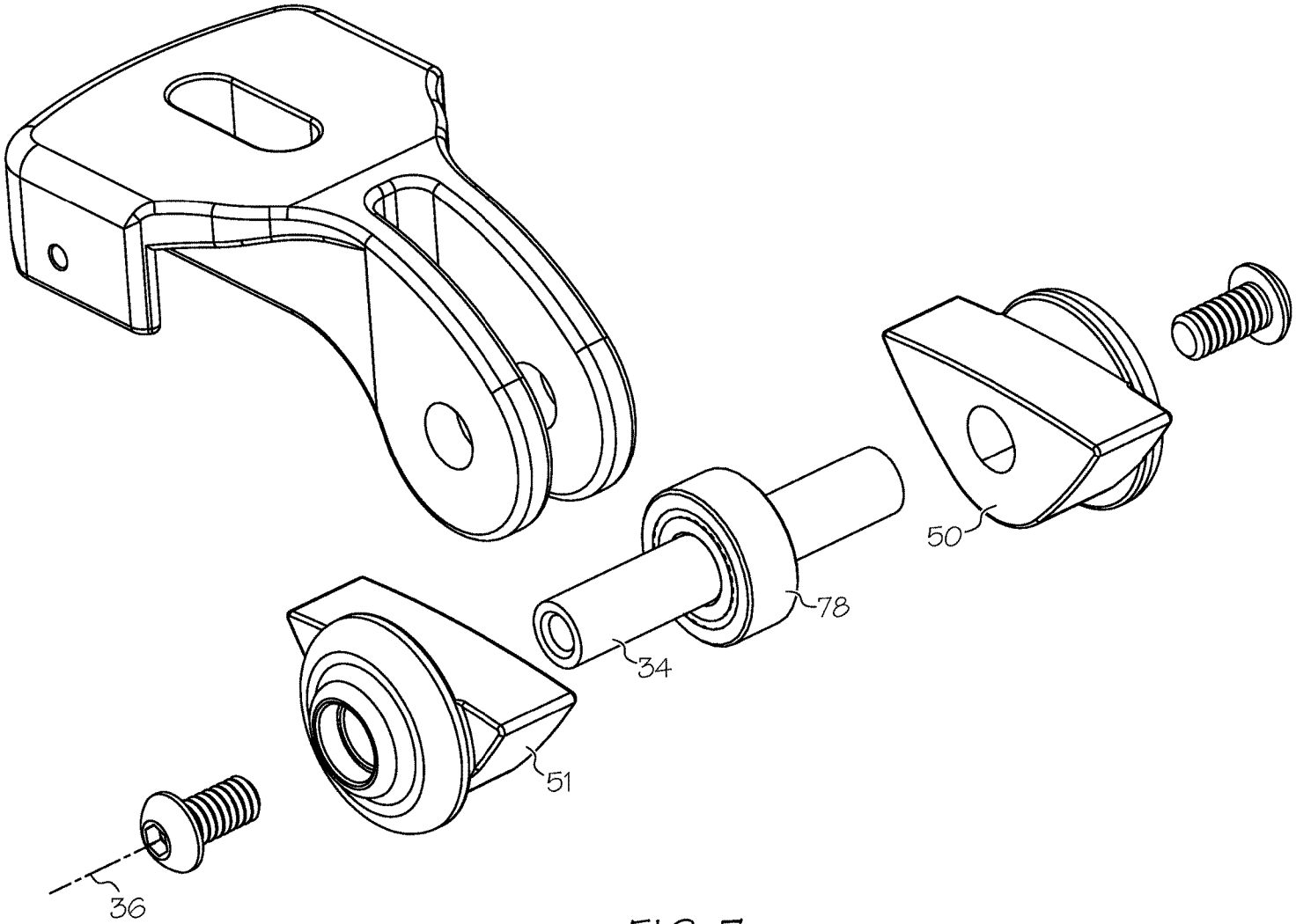
FIG. 7 shows an exploded view of the limb cup of FIG. 6.

FIGS. 6 and 7 show another embodiment of a limb cup 20. In some embodiments, the limb cup 20 comprises a bearing 78 oriented between the frame of a bow and the axle 34. This reduces friction and helps the limb support member(s) 50, 51 to pivot about the pivot axis 36. FIG. 7 shows the limb cup 20 in an exploded view. In some embodiments, a bearing 78 surrounds the axle 34.

A bearing 78 can comprise any suitable type of bearing. In some embodiments, a bearing 78 comprises a sleeve made from a metal, a polymer, etc. In some embodiments, a bearing 78 comprises a roller bearing or any other suitable type of friction reducing bearing.

Figure 8:
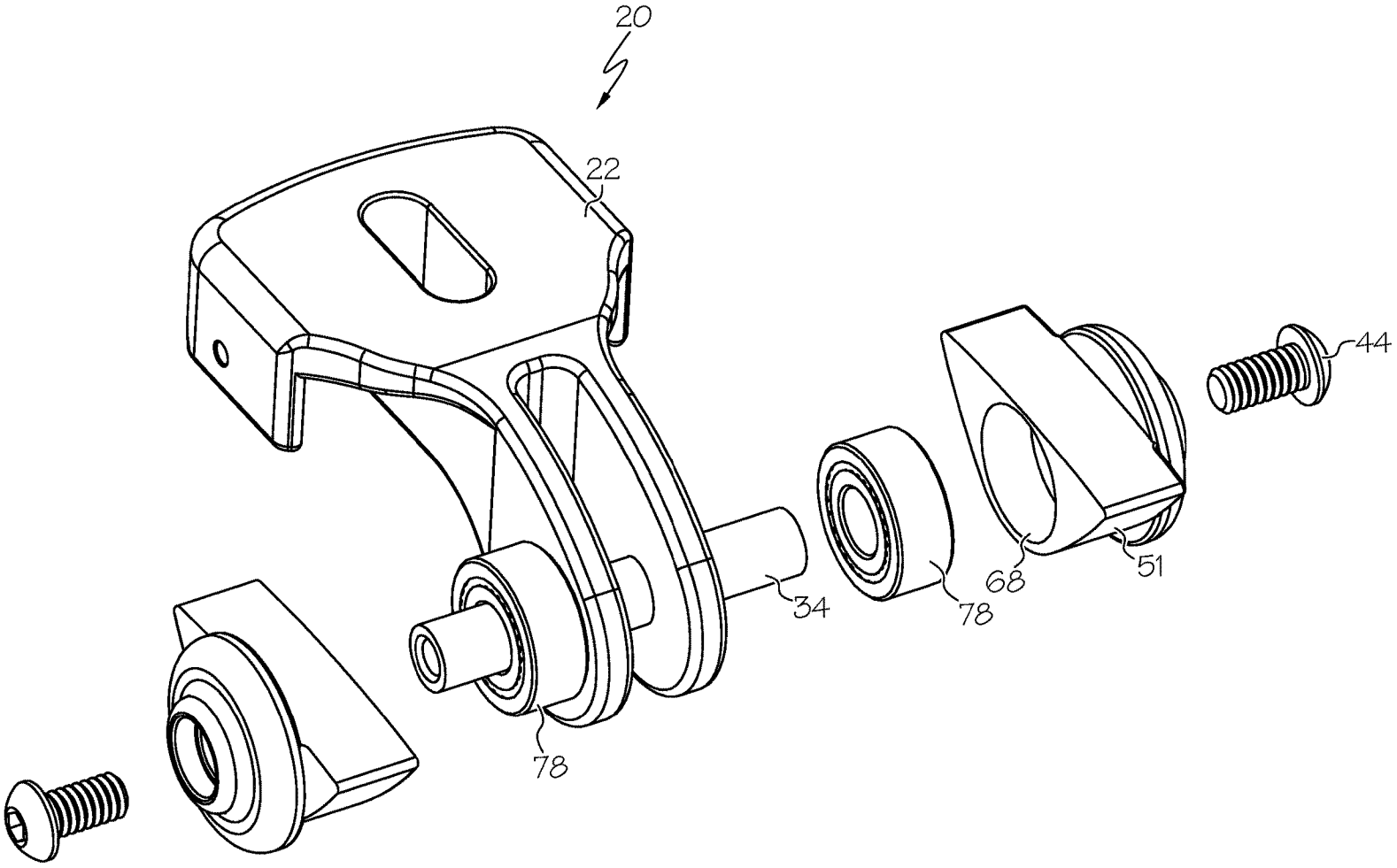
FIG. 8 shows another embodiment of a limb cup.

FIG. 8 shows another embodiment of a limb cup 20. In some embodiments, a bearing 78 is provided between the axle 34 and a limb support member 50. In some embodiments, a limb support member 50 comprises a cavity 68 configured to receive a bearing 78.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A limb cup comprising:

a body defining a cavity at a first support location, the cavity partially defined by a first sidewall, the first sidewall extending to a second support location;

an axle supported by the body;

a first limb support member supported by the axle, a second limb support member supported by the axle, the first limb support member rotatable with respect to the body about a central axis of the axle, the second limb support member rotatable with respect to the first limb support member, the first limb support member comprising a limb pad and a flange comprising a second sidewall, the second support location defined by the first sidewall, the limb pad and the second sidewall, the limb pad comprising curvature and being concave with respect to the axle, wherein a radius of curvature of the limb pad is greater than a radius of curvature of the axle.

2. The limb cup of claim 1, the first limb support member arranged to contact a compression surface of a limb, a surface of the body defining the cavity arranged to contact a tension surface of a limb.

3. The limb cup of claim 1, the second limb support member rotatable with respect to the axle.

4. The limb cup of claim 1, the body comprising an aperture, the axle extending through the aperture.

5. The limb cup of claim 1, comprising a fastener attaching the first limb support member to the axle.

6. The limb cup of claim 5, the axle comprising a cavity that receives the fastener.

7. The limb cup of claim 1, the first limb support member comprising an aperture, the axle extending through the aperture.

8. The limb cup of claim 1, the second limb support member comprising a sidewall arranged to contact a side surface of a limb.

9. The limb cup of claim 1, further comprising a bearing located between the axle and the first limb support member.

10. A limb cup comprising:

a body defining a cavity at a first support location, the cavity partially defined by a first sidewall, the first sidewall extending to a second support location;

an axle supported by the body;

a limb support member supported by the axle, the limb support member rotatable with respect to the axle about a central axis of the axle, the limb support member rotatable with respect to the body, the limb support member comprising a limb pad and a flange comprising a second sidewall, the second support location defined by the first sidewall, the limb pad and the second sidewall, the limb pad comprising curvature and being concave with respect to the axle, a radius of curvature of the limb pad being greater than a radius of curvature of the axle;

wherein the axle is rotatable with respect to the body.

11. An archery bow comprising:

a frame;

a first limb and a second limb;

a limb cup supported by the frame, the limb cup contacting the first limb at a first support location and at a second support location, the limb cup comprising:

a body member defining a first cavity and a second cavity, the first cavity located at the first support location, the first cavity defined by a first sidewall, the first sidewall extending to the second support location;

an axle; and a first limb support member and a second limb support member, the first limb support member being rotatable with respect to the body about a central axis of the axle, the first limb support member comprising a limb pad and a second sidewall, the limb pad comprising curvature and being concave with respect to the axle, the second limb support member rotatable with respect to the first limb support member;

wherein a portion of the first limb is oriented in the first cavity, a portion of the limb pad contacts a compression surface of the first limb and the second support location is defined by the first sidewall, the limb pad and the second sidewall.

12. The archery bow of claim 11, the frame comprising an aperture, the axle extending through the aperture.

13. The archery bow of claim 11, wherein the axle is rotatable with respect to the body member.

14. The archery bow of claim 11, wherein a portion of the limb cup that defines the first cavity contacts a tension surface of the first limb.

15. The archery bow of claim 11, the body member comprising an aperture, the axle extending through the aperture.

16. The archery bow of claim 11, comprising a fastener attaching the first limb support member to the axle.

17. The archery bow of claim 16, the axle comprising a cavity that receives the fastener.

18. The archery bow of claim 11, the first limb support member comprising an aperture, the axle extending through the aperture.

19. The archery bow of claim 11, further comprising a roller bearing oriented between the frame and the axle.

20. The archery bow of claim 11, further comprising a roller bearing located between the axle and the first limb support member.

* * * * *